US008979483B2

(12) United States Patent
Suciu et al.

(10) Patent No.: US 8,979,483 B2
(45) Date of Patent: Mar. 17, 2015

(54) MID-TURBINE BEARING SUPPORT

(75) Inventors: Gabriel L. Suciu, Glastonbury, CT (US); Christopher M. Dye, San Diego, CA (US); Steven J. Bauer, East Haddam, CT (US)

(73) Assignee: United Technologies Corporation, Hartford, CT (US)

( * ) Notice: Subject to any disclaimer, the term of this patent is extended or adjusted under 35 U.S.C. 154(b) by 600 days.

(21) Appl. No.: 13/290,598

(22) Filed: Nov. 7, 2011

(65) Prior Publication Data

US 2013/0115057 A1 May 9, 2013

(51) Int. Cl.
*F04D 29/08* (2006.01)
*F01D 25/16* (2006.01)
*B23P 17/00* (2006.01)

(52) U.S. Cl.
CPC ..... *F01D 25/162* (2013.01)
USPC ..... 415/142; 416/174; 415/229

(58) Field of Classification Search
CPC ..... F01D 25/16; F01D 25/162; F01D 25/24; F01D 25/243; F01D 25/246; F01D 25/28; F05D 2230/60–2230/68; F05D 2240/14; F05D 2240/50; F02C 7/16; F16C 23/06; F16C 35/067; F16C 35/077; F16C 2360/23
USPC ..... 415/142, 229–230, 213.1, 214.1; 416/174
See application file for complete search history.

(56) References Cited

U.S. PATENT DOCUMENTS

| | | | | |
|---|---|---|---|---|
| 5,272,869 | A * | 12/1993 | Dawson et al. | 60/796 |
| 6,439,841 | B1 * | 8/2002 | Bosel | 415/142 |
| 6,883,303 | B1 | 4/2005 | Seda | |
| 7,677,047 | B2 * | 3/2010 | Somanath et al. | 60/796 |
| 7,775,049 | B2 | 8/2010 | Kumar et al. | |
| 7,797,946 | B2 * | 9/2010 | Kumar et al. | 60/796 |
| 8,312,726 | B2 * | 11/2012 | Wong et al. | 60/796 |
| 8,316,523 | B2 * | 11/2012 | Durocher et al. | 29/445 |
| 2011/0056213 | A1 | 3/2011 | Somanath et al. | |

* cited by examiner

*Primary Examiner* — Dwayne J White
*Assistant Examiner* — Alexander White
(74) *Attorney, Agent, or Firm* — Carlson, Gaskey & Olds, P.C.

(57) ABSTRACT

A bearing assembly for a gas turbine engine includes a bearing, an outer assembly disposed about an axis and having an angled perimeter, and an inner assembly supporting the bearing and having a surface angled to slide against and attach to the angled perimeter as the bearing is aligned with the axis.

20 Claims, 4 Drawing Sheets

MID-TURBINE BEARING SUPPORT

TECHNICAL FIELD

The invention relates to spool support structures used within gas turbine engines in general, and to spool support structures for multi-spool gas turbine engines in particular.

BACKGROUND OF THE INVENTION

A gas turbine engine generally includes a fan, a low pressure compressor, a high pressure compressor, a combustor section, a low pressure turbine, and a high pressure turbine disposed along a common longitudinal axis. The fan and compressor sections input work into the ambient air drawn into the engine, thereby increasing the pressure and temperature of the air. Fuel is added to the worked air and the mixture is burned within the combustor section. The combustion products and any unburned air subsequently power the turbine sections and exit the engine and may produce thrust. A low pressure spool (sometimes referred to as an "axial shaft") connects the fan, which may also produce thrust, and a low pressure compressor and the low pressure turbine. A high pressure spool (sometimes referred to as an "axial shaft") connects the high pressure compressor and the high pressure turbine. The low pressure spool and high pressure spool are rotatable about the longitudinal axis.

It is known to use support frames (e.g., with circumferentially distributed struts) to support the low and high pressure spools within the gas turbine engine. The support frames extend radially toward each respective spool and have a bearing disposed at a distal end, which bearing is in contact with the spool. The bearings facilitate rotation of the spools and provide a load path between the spool and the support frame.

The angular momentum ("L") of the axial shaft, which is a function of its angular velocity (".omega."), imparts a torque to the frame to which the bearing is mounted. The torque, in turn, creates shear stress within the frame. To accommodate the torque and concomitant stress, the frame may include a torque box.

SUMMARY OF THE INVENTION

According to an embodiment disclosed herein, a bearing assembly for a gas turbine engine includes a bearing, an outer assembly disposed about an axis and having an angled perimeter, and an inner assembly supporting the bearing and having a surface angled to slide against and attach to the angled perimeter as the bearing is aligned with the axis.

According to a further embodiment disclosed herein, an assembly for supporting a bearing includes an outer casing, an inner casing having an outer surface, and a plurality of struts connecting the inner casing and the outer casing, each strut having a surface disposed at a complimentary angle to the outer surface. The surface and the outer surface move relative to each other in plane as the bearing is aligned along an axis. A fastener attaches the surface to the outer surface after the bearing is aligned with the axis.

According to a further embodiment disclosed herein, a method of assembling a rotating engine includes the steps of: providing a bearing, providing an outer assembly disposed about an axis and having an angled perimeter greater than zero degrees; providing an inner assembly for supporting the bearing and having a surface angled at a same angle as the perimeter; and sliding the angled perimeter along the surface in plane while aligning the bearing along the axis.

These and other features of the invention would be better understood from the following specifications and drawings, the following of which is a brief description.

DETAILED DESCRIPTION

Figure 1:
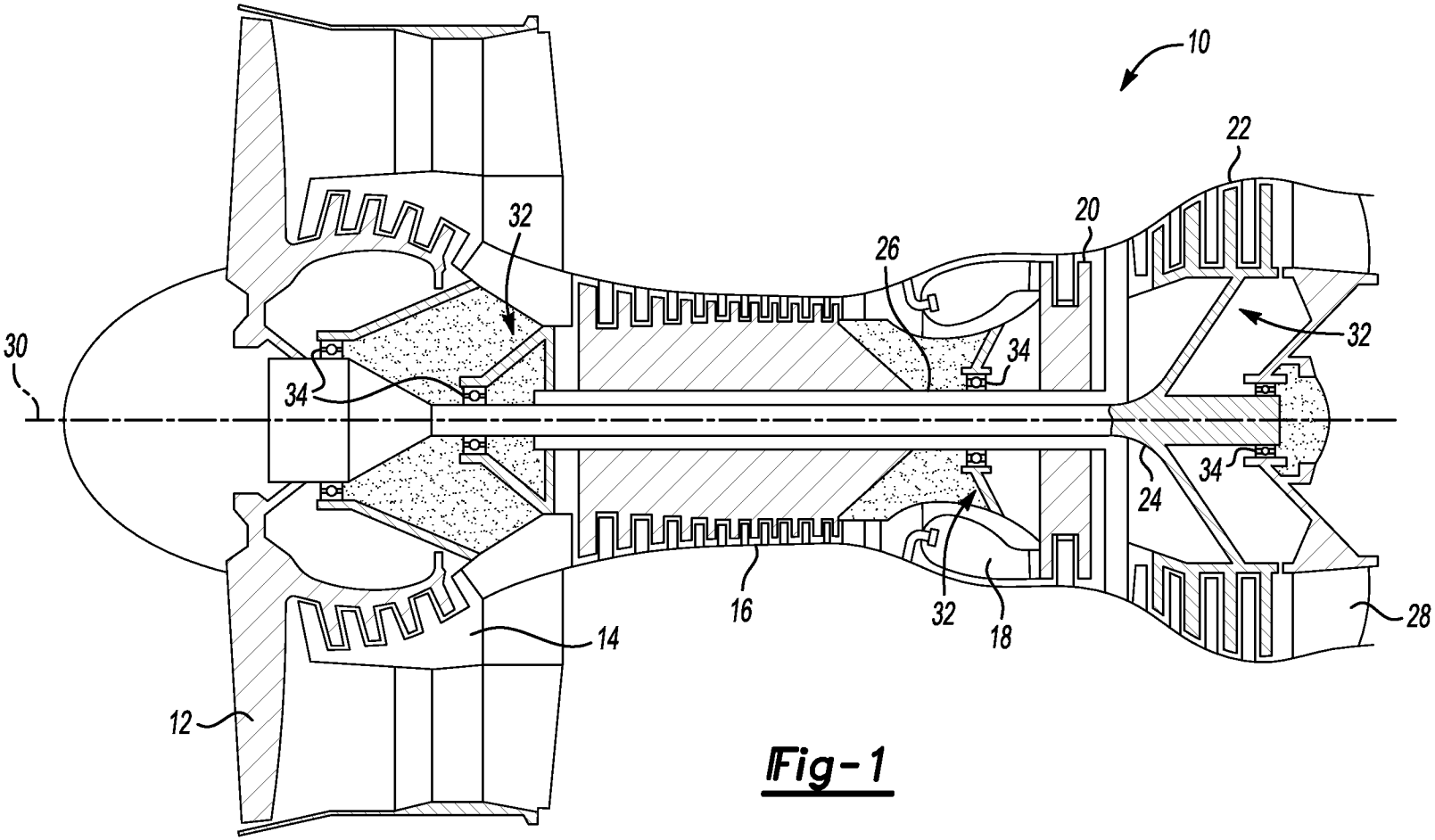
FIG. 1 is a cross-sectional perspective view of gas turbine engine.
Figure 2:
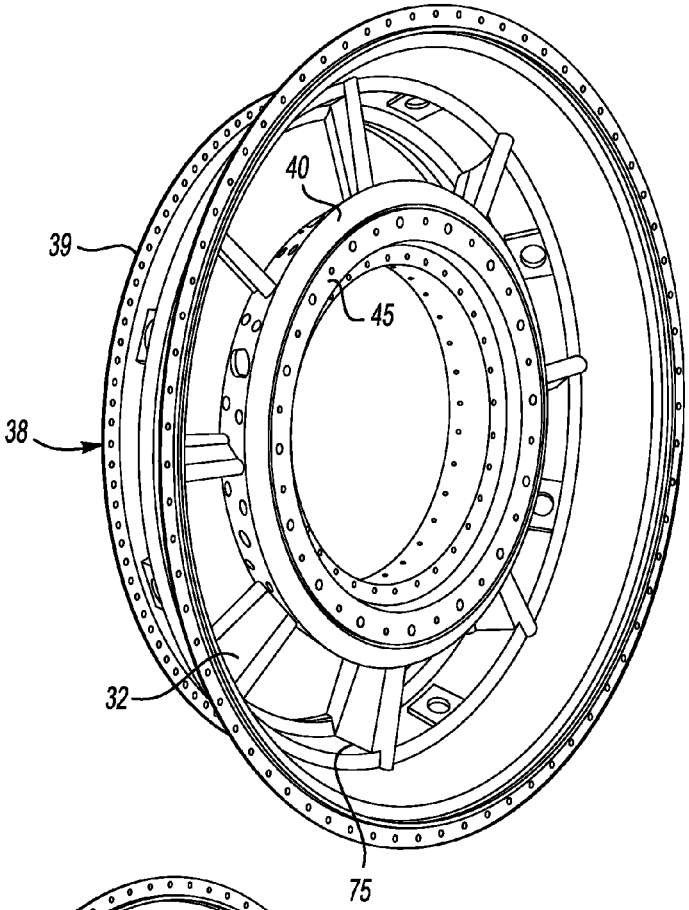
FIG. 2 is a perspective view of an assembly that forms a portion of the gas turbine engine of FIG. 1.

Referring to FIGS. 1-2, a gas turbine engine 10 includes a fan 12, a low pressure compressor 14, a high pressure compressor 16, a combustor 18, a high pressure turbine 20, a low pressure turbine 22, a low pressure spool 24, a high pressure spool 26, and a nozzle 28. Each compressor and turbine section 14, 16, 20, 22 include a plurality of stator vane stages and rotor stages (shown generally herein). Each stator vane stage includes a plurality of stator vanes that guide air into or out of a rotor stage in a manner designed in part to optimize performance of that rotor stage. Each rotor stage includes a plurality of rotor blades attached to a rotor disk. The low pressure spool 24 extends between, and connects the low pressure compressor 14 to the high pressure turbine 20 and the fan 12. The high pressure spool 26 extends between, and is connected with, the high pressure compressor 16 and the low pressure turbine 22. The low pressure spool 24 and the high pressure spool 26 are concentric and rotatable about the longitudinally extending axis 30 of the engine. One of ordinary skill in the art will recognize that other arrangements of the components of the gas turbine engine 10 are within the teachings made herein.

Figure 3:
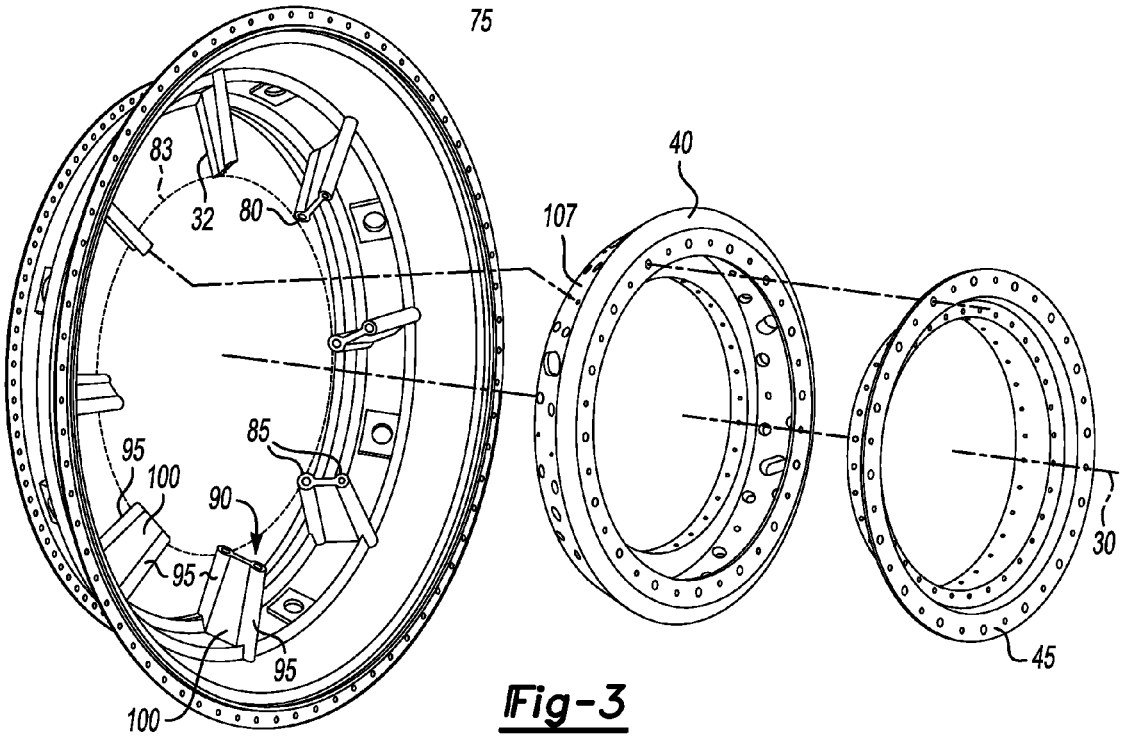
FIG. 3 is an exploded view of the assembly of FIG. 2.
Figure 4:
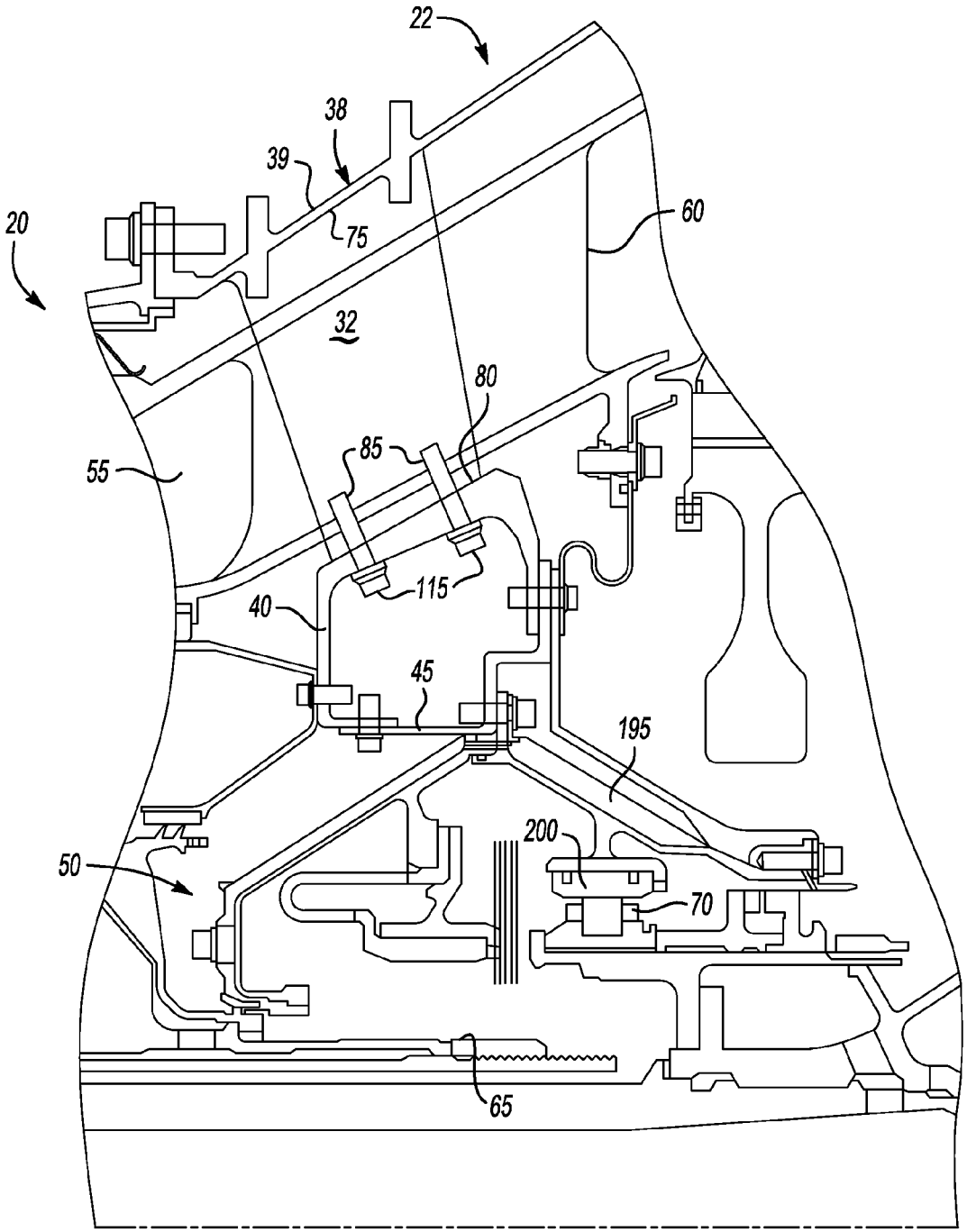
FIG. 4 shows the assembly of FIG. 2 within the environment of a gas turbine engine.

Referring now to FIGS. 2-4, an embodiment of an assembly 38 (shown schematically in FIG. 2) is disposed between the high pressure turbine 20 and the low pressure turbine 22. The assembly 38 supports bearings rotatably supporting the low pressure spool 24 and the high pressure spool 26 as will be discussed herein below. The assembly 38 has a casing 39, a ring structure 40 disposed within the casing 39, and a cover 45 for attaching the assembly 39 to a bearing structure 50. The casing 39 is attached to the ring structure 40 (e.g., an inner assembly) by struts 32 (e.g., an outer assembly). The ring structure and the cover 45 form a torque box that resists bending and thrust moments.

Referring to FIG. 4, each strut 32 fits within a hot air passage 55 through which highly energized air passes from the high pressure turbine 20 to the low pressure turbine 22. Each strut 32 is enclosed by a fairing 60, which directs air to the low pressure turbine 22 at a particular angle as is known in the art. The bearing structure 50 has a high pressure spool bearing 65, and a low pressure spool bearing 70 that are supported thereby and as will be discussed herein.

Referring back to FIGS. 2-4, struts 32 are welded at their outer diameters 75 to the casing 39. The inner diameter portions 80 of each strut 32 form the shape of a cone about a virtual perimeter 83 thereof. A pair of bolt holes 85 is disposed in an inner diameter 80 of the struts 32. Each strut 32 essentially forms an I-beam shape 90 and has a pair of beams 95 each having a bolt hole 85 therein. The beams 95 are connected by a web 100. The struts 32 are disposed at a particular angle relative to the air flow passing through the gas turbine engine 10 to provide stiffness in the radial and axial directions to counteract the massive torque created by combustion gases passing over turbine airfoils within the gas turbine engine 10. An inner diameter 80 has an angle α relative to axis 30 passing through the gas turbine engine 10 to conform with the shape of the hot air passage 55 (see FIGS. 4 and 6). The beams 95 are circular but other shapes are within the teachings described herein. The struts have good stiffness and torsional rigidity fore and aft. The angles of the struts could be between 30° and 60° relative to a direction of flow through the engine 10.

The ring structure 40 has an outwardly angled surface 105 that cooperates with the inner diameter 80 of the struts 32 also at angle α relative to axis 30 passing through the gas turbine engine 10. The surface 105 creates a conical surface about the ring structure perimeter 107. Oversized holes 110 passing through the angled surface 105 receive bolts 115 (e.g., fasteners) there through that attach within the bolt holes 85 in the beams 95 of the struts 32. See also FIG. 6.

Figure 5:
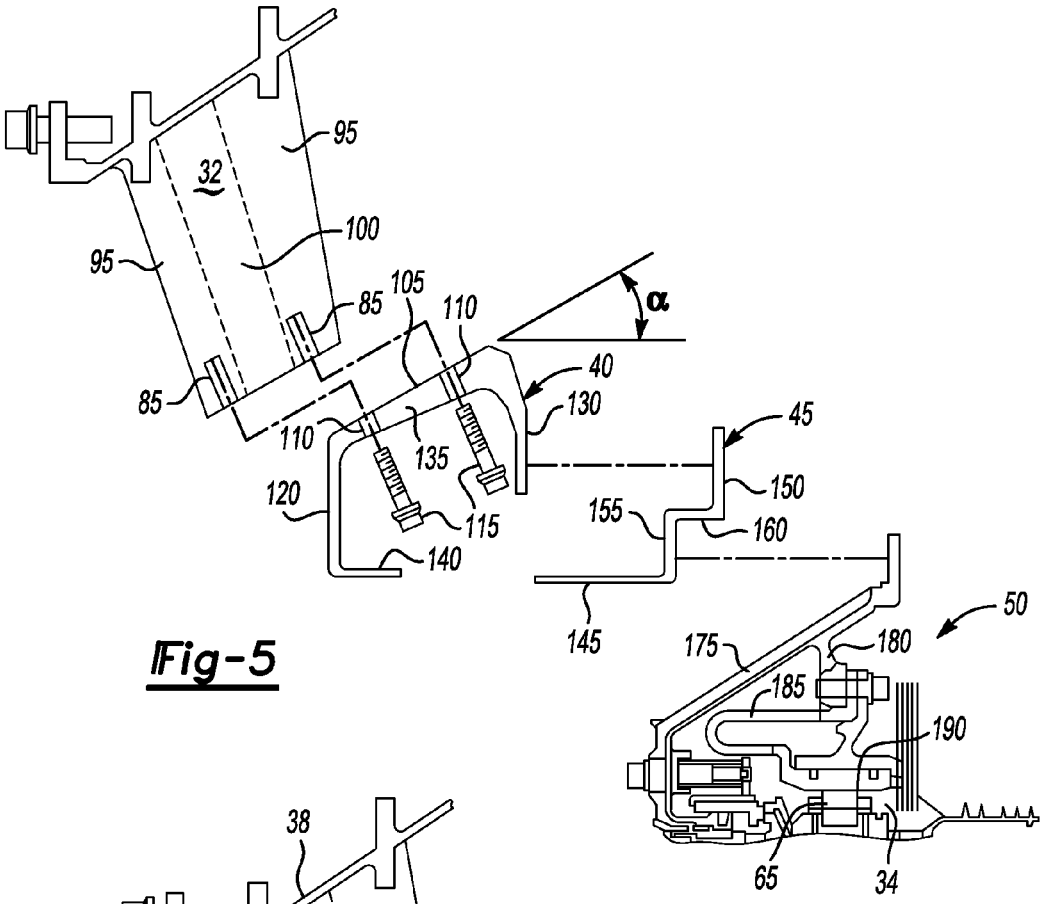
FIG. 5 shows a portion of the assembly of FIG. 4 in a disassembled state.
Figure 6:
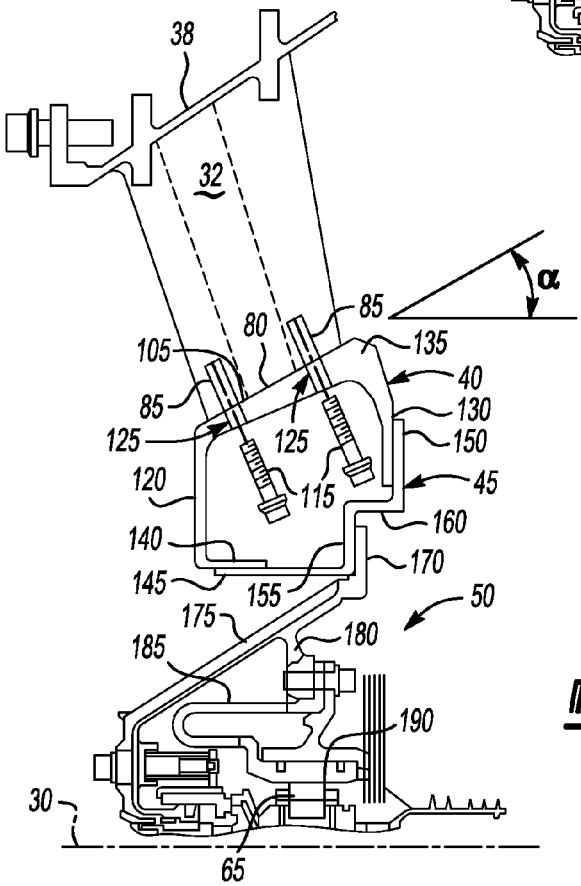
FIG. 6 shows a portion of the assembly of FIG. 5 in a reassembled state.

Referring now to FIGS. 4-6, the ring structure 40 has a first radially inwardly extending flange 120 extending from a first end 125 thereof, and a second radially inwardly extending flange 130 extending from a second end 135 thereof. A first axially extending flange 140 extends axially aft from the first radially inwardly extending flange 120 to mate with the inner cover 45 as will be discussed herein. Similarly, the second radially inwardly extending flange 130 also mates with the cover assembly 45 as will be discussed herein.

The cover 45 is the second axially extending flange 145 cooperating with the first axially extending flange 140 for attachment thereto by bolts or other means. The third radially extending flange 150 cooperates with the second radially extending flange 120 on the ring structure 40. A fourth radially extending flange 155 that extends radially outwardly from the second axially extending flange 145 attaches to the bearing structure 15 as will be discussed herein. The third radially extending flange 150 and fourth radially extending flange 155 are connected by an axially extending connector 160.

The bearing structure 50 has an upright bracket 170 that attaches to the fourth radially inwardly extending flange 155 by bolts or otherwise. An angled support 175 extends axially forward and has an attaching attachment 180 that supports a U-shaped land 185 having a land surface 190. The land surface 190 supports bearings 65 attaching to the high pressure spool bearing 65. Similarly, complimentary bracket 195 (see FIG. 3-4) extends radially aft and supports a land 200 which supports bearings bearing 70 about which the low pressure spool rotates.

While machining is remarkably accurate, there are always some intolerances within an engine 10. In order to minimize the effect of the intolerances, and the stresses that may accompany them, the assembly 38 takes the intolerances into account. For instance, oversized holes 110 allow sliding along the inner diameter end 80 of the struts and the angled surface 105 of the ring structure as the low pressure spool 24 and the high pressure spool 26 are aligned along axis 30. The perimeter of the struts 32 aligns with the perimeter 107 of the angled surface 105. Because the lands 190 and 200 are oversized, any sliding between the strut inner diameter 80 and the ring structure outer angled surface 105 causes the lands 190, 200 to move axially along the bearings 65, 70 to account for tolerance deviations thereof.

Although an embodiment of this invention has been disclosed, a worker of ordinary skill in this art would recognize that certain modifications would come within the scope of this invention. One of ordinary skill in the art will recognize that the teachings herein are applicable to other bearing assemblies, including other bearing assemblies in gas turbine engines.

For that reason, the following claims should be studied to determine the true scope and content of this invention.

We claim:

1. A bearing assembly for a gas turbine engine, said assembly comprising:

a bearing;

an outer assembly disposed about an axis and having an angled perimeter greater than zero degrees relative to said axis;

an inner assembly supporting said bearing and having a surface angled to slide against and attach to said angled perimeter as said bearing is aligned with said axis, wherein said surface is angled at a same angle as said angled perimeter; and a support disposed between said inner assembly and said bearing wherein said support and said inner assembly form a torque box.

2. The bearing assembly of claim 1 wherein said outer assembly includes a plurality of struts attached to an outer casing.

3. The bearing assembly of claim 2 wherein said struts comprise an I-beam shape.

4. The bearing assembly of claim 2 wherein said surface slides along an inner diameter of said struts as said bearing is aligned with said axis.

5. The bearing assembly of claim 4 wherein fasteners pass through openings in said surface and attach to said struts.

6. The bearing surface of claim 5 wherein said openings are greater than a diameter of said fasteners to allow relative movement between said struts and said surface while aligning said bearing with said axis.

7. The bearing assembly of claim 1 wherein said inner assembly is a cone.

8. The bearing assembly of claim 1 wherein said bearing supports a low pressure spool.

9. The bearing assembly of claim 1 wherein said bearing supports a high pressure spool.

10. The bearing assembly of claim 1 wherein said outer assembly includes a plurality of struts attached to an outer casing, said struts comprise an I-beam shape, said surface slides along an inner diameter of said struts as said bearing is aligned with said axis, and said inner assembly is a cone.

11. The bearing assembly of claim 1 wherein said support is separate from said inner assembly.

12. An assembly for supporting a bearing comprising:

an outer casing;

an inner casing having an outer surface;

a plurality of struts connecting said inner casing and said outer casing each strut having a surface disposed at a complimentary angle greater than zero degrees to said outer surface wherein said surface and said outer surface move relative to each other as said bearing is aligned along an axis, wherein said struts comprise an I-beam shape; and a fastener for attaching said surface to said outer surface after said bearing is aligned with said axis, wherein the outer casing includes an angled perimeter greater than zero degrees relative to said axis and said outer surface is angled at a same angle as said angled perimeter.

13. The assembly of claim 12 wherein each strut has a pair of end portions, each end portion having an opening for receiving said fastener therein.

14. The assembly of claim 13 wherein each end portion is rod-shaped.

15. The assembly of claim 13 wherein said end portions are connected by a web.

16. The assembly of claim 13 wherein said fastener is a bolt.

17. The assembly of claim 13 wherein said fastener passes through an oversized opening in said outer surface to allow relative movement between said outer surface and said surface in plane.

18. A method of assembling a rotating engine, said method comprising providing a bearing, providing an outer assembly disposed about an axis and having an angled perimeter greater than zero degrees, providing an inner assembly for supporting said bearing and having a surface angled at a same angle as said angled perimeter, sliding said angled perimeter along said surface while aligning said bearing along said axis.

19. The method of claim 18 further comprising:

affixing said angled perimeter to said surface after aligning said bearing along said axis.

20. The method of claim 18 further comprising:

providing oversized fastening holes in one of said inner assembly or said outer assembly to permit attachment of said inner assembly to said outer assembly after aligning said bearing along said axis.

* * * * *